US005840005A

United States Patent [19]

Lowe et al.

[11] Patent Number: 5,840,005

[45] Date of Patent: Nov. 24, 1998

[54] CENTRIFUGE WITH INERTIAL MASS RELIEF

[75] Inventors: Winston H. H. Lowe, Sunnyvale; Thomas L. Johnson, Fremont, both of Calif.

[73] Assignee: Beckman Instruments, Inc., Fullerton, Calif.

[21] Appl. No.: 873,063

[22] Filed: Jun. 11, 1997

Related U.S. Application Data

[63] Continuation-in-part of Ser. No. 721,165, Sep. 26, 1996, abandoned.

[51] Int. Cl.[6] ..... B04B 5/02

[52] U.S. Cl. ..... 494/16

[58] Field of Search ..... 494/12, 16, 20, 494/33, 81, 85; 74/572

[56] References Cited

U.S. PATENT DOCUMENTS

| | | | |
|---|---|---|---|
| 2,447,330 | 8/1948 | Grebmeier . | |
| 3,819,111 | 6/1974 | Romanauskas et al. . | |
| 4,817,453 | 4/1989 | Breslich, Jr. et al. | 494/16 X |
| 4,824,429 | 4/1989 | Keunen et al. | 494/16 |
| 4,991,462 | 2/1991 | Breslich, Jr. et al. | 74/572 |
| 5,071,402 | 12/1991 | Weyant, Jr. | 494/16 |
| 5,279,538 | 1/1994 | Carson | 494/81 |
| 5,362,301 | 11/1994 | Malekmadani et al. | 494/16 |
| 5,484,381 | 1/1996 | Potter | 494/12 |
| 5,562,554 | 10/1996 | Carson | 494/12 |

FOREIGN PATENT DOCUMENTS 2097297 11/1982 United Kingdom .

*Primary Examiner*—Charles E. Cooley
*Attorney, Agent, or Firm*—William H. May; P. R. Harder; Thomas Schneck

[57] ABSTRACT

A solid mass rotor for centrifuges of the type supporting sample containers in cells which are radially positioned apertures in the rotor body features a cross-sectional shape which is relieved by a plurality of apertures, a first subset of which defines cells and a second subset of which defines relief zones. The solid mass of the rotor disposed between the cells and the relief zones defines a plurality of spokes extending from a radially central spin axis. The relief zones reduce the mass and overall moment of inertia of the rotor, while maintaining the strength and high speed capability associated with solid mass rotors.

26 Claims, 5 Drawing Sheets

CENTRIFUGE WITH INERTIAL MASS RELIEF

CROSS-REFERENCE TO RELATED APPLICATION

This is a continuation-in-part of patent application Ser. No. 08/721,165, filed Sep. 26, 1996, now abandoned.

DESCRIPTION

1. Technical Field

The invention relates to centrifuge rotors, and more particularly to high speed solid mass rotors.

2. Background Art

Solid mass rotors are used for high volume, high speed centrifuge applications. High volume is achieved within a plurality of radially disposed cells which are formed by bores extending into a cylindrically symmetric mass of material. The cells have a volume and shape which accommodate a closely fitting test tube or cuvette with good wall support about most or all of the test tube wall surface. While other rotors, such as swinging bucket rotors, can also be designed for good wall support, such rotors do have the capacity of solid mass rotors for supporting a plurality of tubes.

On the other hand, there are certain problems encountered with solid mass rotors. Heavy rotors are difficult for users to transport. The rotors have high inertia and require longer acceleration and deceleration times. The high mass rotors have inherently higher stresses during operation.

One mass reduction approach for prior art solid mass rotors has been to remove material from the bottom or from exterior surfaces by fashioning scallops or indentations. An example of this is shown in U.S. Pat. No. 3,819,111 to Romanauskas et al. Arch-like cuts in the periphery of the rotor skirt reduce the mass of the skirt. One problem with scallops is that they increase aerodynamic drag, thereby increasing windage losses, increasing power consumption. The windage losses limit maximum achievable operating speeds.

U.K. Pat. Appln. No. 2,097,297 to Tokushige discloses, in pertinent part, a fiber-composite centrifuge rotor having a plurality of radial arms angularly spaced at equal intervals and paired in diametrically opposite relation across the spin axis of the rotor. A bucket is disposed in each of the plurality of arms and a void is positioned between the bucket and the spin axis. Each void extends completely through the rotor body.

U.S. Pat. No. 5,484,381 to Potter discloses a centrifuge rotor having, in pertinent part, a plurality of cavities, each of which has a mouth. Also included in the rotor are a plurality of liquid-capturing holes, each of which is disposed between two adjacent cavities and has a mouth. The mouth of each liquid-capturing hole is formed in the same surface as the mouth of each of the plurality of cavities.

An object of the invention is to reduce mass in a solid mass centrifuge rotor without increasing windage losses.

SUMMARY OF THE INVENTION

The above object has been achieved by formation of a plurality of apertures within a rotor body that define a plurality of spokes extending between the rotor's spin axis and exterior surface. In this fashion, the plurality of apertures reduce the rotor's mass and, therefore, the rotor's moment of inertia. The rotor's exterior surface provides good aerodynamic properties to reduce the effects of windage, and the plurality of spokes provide the needed strength for the rotor's safe operation. By reducing the mass of the rotor, acceleration and deceleration may be quicker and the rotor will be lighter.

In the present invention, the rotor has cylindrical symmetry about a central spin axis. The outer periphery of this shape forms a peripheral wall extending from an upper truncation level to an underside disposed opposite thereto. A first subset of the plurality of apertures are adapted to hold sample containers, defining sample cells. The shape of the sample containers to be used should conform to the shape of the sample cells for good wall support. A second set of the plurality of apertures define relief zones formed between the sample cells. The second subset of apertures extend from the underside toward the upper truncation level. These relief zones reduce the mass of the rotor, in addition to the mass reduction provided by the sample cells. In this fashion, the moment of inertia of the rotor is further reduced by an amount approximately equal to the mass removed from the relief zones multiplied by the square of the mean radius.

BEST MODE OF CARRYING OUT THE INVENTION

Figure 1:
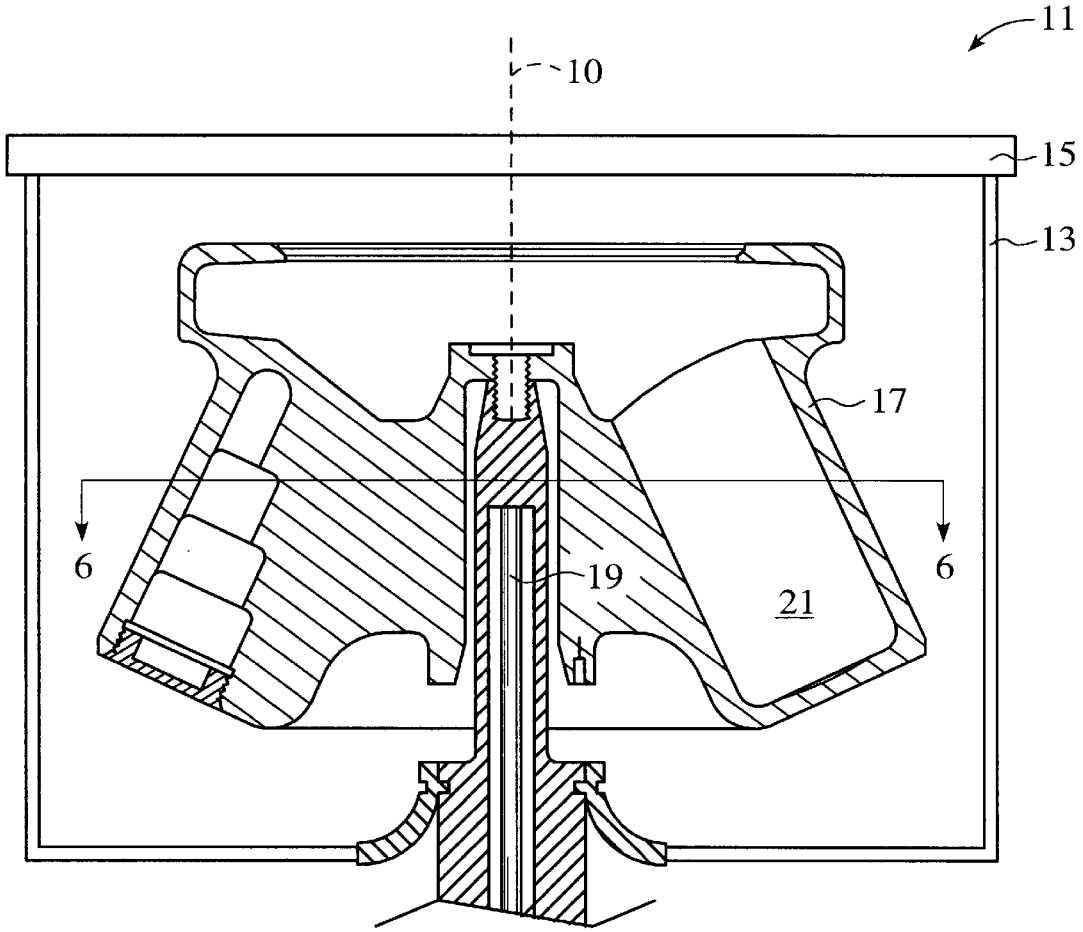
FIG. 1 is a side elevational view of a solid mass rotor in a centrifuge housing in accord with the present invention.

With reference to FIG. 1, a high-speed centrifuge 11 is shown to reside in a housing 13. Access to the housing 13 is by means of a removable cover 15 which allows a user to have access to a rotor 17. The rotor 17 is driven by a drive shaft 19 located along the spin axis 10 of the rotor 17. Sample cell 21 holds a sample container, not shown, which may be a bottle, test tube or cuvette that has walls closely following the walls of the sample cell 21 so that the container receives good support during high-speed rotation. Sample cells 21 are defined in the rotor 17 by apertures or bores formed in the solid mass of rotor 17. The apertures or bores are formed at an angle at which the sample container, not shown, would be driven if it were free to tilt at high speed rotation, as in a swinging-bucket rotor. A motor, not shown, provides rotational energy to drive shaft 19 for acceleration and deceleration of the rotor.

Figure 2:
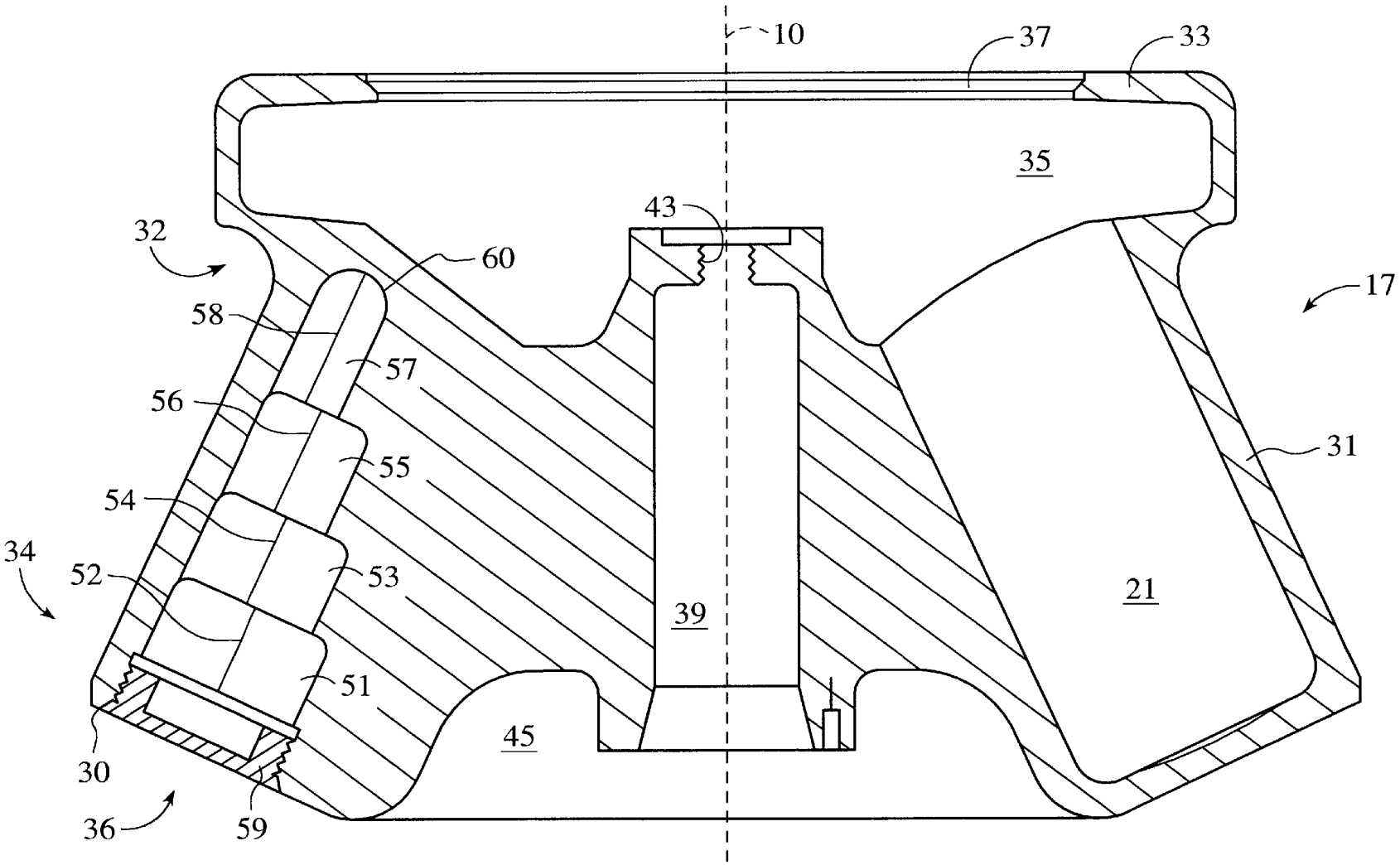
FIG. 2 is a vertical sectional view of the solid mass centrifuge rotor illustrated in FIG. 1.

With reference to FIG. 2, rotor 17 is seen to have a frusto-conical shape, principally defined by skirt 31 which lies below a plane of truncation 33. Immediately above the skirt, but below the plane of truncation 33 is a central access aperture 35 which allows positioning of sample containers, not shown, into sample cells, such as sample cell 21. The plane of truncation 33 contains a central orifice 37 which gives access to the central access aperture 35. The central orifice 37 is a large opening, occupying more than two-thirds of the plane of truncation 33.

Axial shaft 39 in the cylindrical opening is symmetrically disposed about the spin axis 10 which is the cylindrical axis for the rotor 17. A drive shaft, not shown, fits into axial shaft 39 and is secured in place by threads 43 that secure a nut or bushing which clamps the rotor to the drive shaft.

On the underside 36 of the skirt 31 is a scalloped region 45 which is axially symmetric about the spin axis 10 and serves to reduce some of the mass of skirt 31. Undercut scallops similar to scalloped region 45 have been known in the prior art.

The present invention features mass relief zones, such as bores 51, 53, 55 and 57 which are apertures in the rotor mass between sample cells such as sample cell 21. The bore 51 may define a mouth 30 in the underside 36 of the skirt 31. The relief zone formed by bores 51, 53, 55 and 57 is made to taper upwardly, because sample cells are inclined and converge toward the spin axis 10 in upper regions 32 of the rotor 17. Therefore, to prevent intersection with the sample cell 21, the bore 53 has a smaller diameter by approximately fifteen percent compared to the bore 51. A center line 54 of the bore 53 is offset outwardly relative to a center line 52 of the bore 51. Similarly, the bore 55 has an approximately fifteen percent smaller diameter than relief region 53. A centerline 56 of the bore 55 is offset radially outwardly from center line 54. Finally, the bore 57 again has a smaller diameter by approximately thirty-three percent relative to the diameter of the bore 55 and forms a closed end 60 of the relief zones that faces the plane of truncation 33. A center line 58 is offset radially outwardly from the center line 56 in an analogous manner as the offset of other center lines.

Although all center lines 52, 54, 56 and 58 are generally parallel to the angle of inclination of skirt 31, forming an oblique angle with respect to the spin axis 10, the relief regions may be formed so that the center lines extend parallel to the spin axis 10. Also, the relief regions may be formed so as to have a constant diameter over the length thereof.

Figure 3:
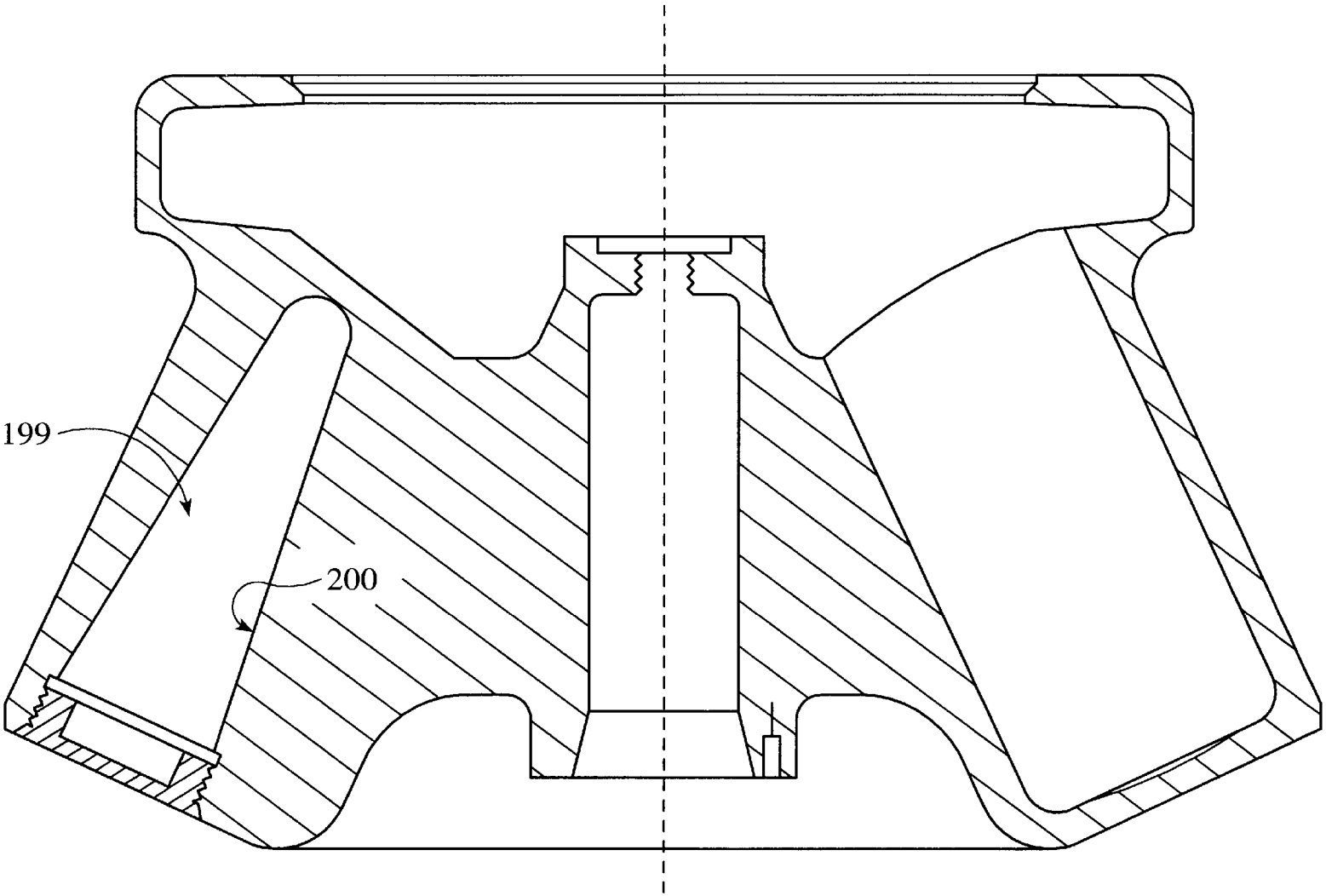
FIG. 3 is a vertical sectional view of the solid mass centrifuge rotor illustrated in FIG. 1, in accord with an alternate embodiment.

The bores 51, 53, 55 and 57 may be formed in the rotor 17 using any technique known in the art. Typically, the different relief regions are formed into the rotor with boring tools or drill bits of different diameter. Alternatively, a conically shaped boring tool, or drill bit, may be employed to form relief zones 199 having a conical surface 200, shown more clearly in FIG. 3.

Referring again to FIG. 2, the mouth 30 and the bore 51 may be formed into the upper regions 32; however, it is preferred that the same be formed into the lower regions 34 to maximize the material that may be removed from the rotor 17. Considering that the typical method for removing material from the skirt 17 involves boring or drilling, it is realized that the relief zones and the mouth 30 could be formed into either the upper regions 32 or the lower regions 34 of the rotor 17. All material, therefore, would be removed from the rotor 17 by passing through the bore 51. Thus, the bore 51 is determinative of the maximum size of the succeeding bores 53, 55 and 57 and, therefore, the amount of material that may be removed from the rotor 17 by the same.

As seen, the lower regions 34 of the rotor skirt 31 have a substantially larger amount of mass than the upper regions 32, which face the truncation level 33. Thus, due to the spatial constraints in the smaller upper regions 32, the bore 51 may be provided with a greater cross-sectional area if formed in the lower regions 34. Therefore, by forming bore 51 in the lower regions 34 of the skirt 31, a greater amount of material may be removed from the rotor 17 by the succeeding bores 53, 55 and 57. Each bore 53, 55 and 57 could be provided with a substantially larger cross-sectional area than would be the case were the bore 51 formed in the upper regions 32 of the skirt 31.

Moreover, inertial relief is also maximized by locating the bore with the largest cross-sectional area, bore 51, in the lower regions 34 of the skirt 31. The moment of inertia I of a solid body is defined by the following:

$$I=\int \rho r^2 dV$$

where ρ is the local volume density and r is the mean perpendicular distance from the axis of rotation to the centroid of the volume element dV. Here the axis of rotation is the spin axis 10. From the equation above, it is seen that the moment of inertia I changes exponentially with changes in r, and linearly with respect to changes in volume. Therefore, by forming the largest bore, bore 51, in the lower regions 34 of the skirt 31, which is farther from the drive shaft 19 than the upper regions 32, the inertial relief provided thereby is maximized. The precise amount of mass which is removed, however, is selected to maintain the balance of the rotor and so more or less mass removal may be appropriate. The mouth 30 is closed by a threaded cap 59, for the same reason the closed end 60 is provided, e.g., preventing air, foreign debris and liquid from entering relief regions and to reduce aerodynamic drag forces, i.e., windage. In addition, closed end 60 precludes the possibility of an end user attempting to insert sample containers into the relief zones. This can be problematic, because the relief zones may be formed to have a substantially larger cross-sectional area than the sample cells 21.

Although the relief zones have been described as being formed with boring tools or drill bits of different diameter passing through a mouth formed into either the upper regions 32 or the lower regions 34, the relief zones may be formed by boring or drilling from both the upper regions 32 and the lower regions 34 of the skirt 31. This would prevent the bore 51 from being determinative of the maximum size of the succeeding bores 53, 55 and 57. The threaded cap 59, however, would have to be included to seal both the upper regions 32 and the lower regions 34 for the reasons discussed above. Providing two caps 59 reduces the amount of inertial relief that may be achieved, because the threaded cap 59 typically consists of a larger volume than the closed end 60 of the bore 57. Were the rotor 17 to be employed in an evacuated chamber, the caps 59 may be abrogated, because the windage is substantially unaffected by their presence. It should be understood that the bores 51, 53, 55 and 57 may be provided with identical cross-sectional areas and that bores 51, 53, 55 and 57 may be coextensive with each other.

Figure 4:
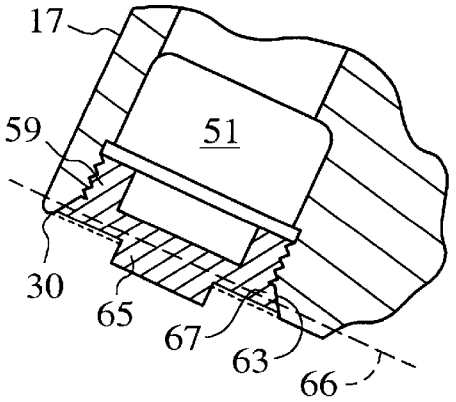
FIG. 4 is a sectional view of a detail of an aperture providing a relief zone in accord with the present invention, shown at an early stage of construction.
Figure 5:
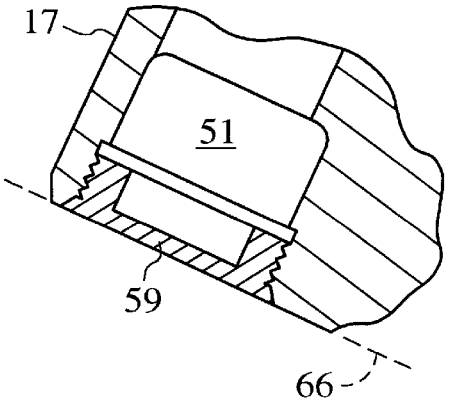
FIG. 5 is a view of the detail of FIG. 3, shown at a finished stage of construction.

In FIG. 4, the mouth 30 has a conical surface 63, with a slightly smaller included angle than a conical surface 67 of the cap 59 which seats thereagainst. The conical surface 67 of the cap 59 ensures face to face contact between the two parts. Sealant is applied to both threads and conical surfaces 63 and 67 prior to tightening. This design allows conical surfaces 63 and 67 to elasticity deform so as to maintain tight contact with each other, during centrifugation. In FIG. 5, the hexagonal head 65 of cap 59 is shown to have been removed by a turning process, such as machining to a level indicated by dashed line 66. Similarly, a portion of conical surface 63 has also been removed, providing for a gapless joint between the cap 59 and the rotor 17.

Figure 6:
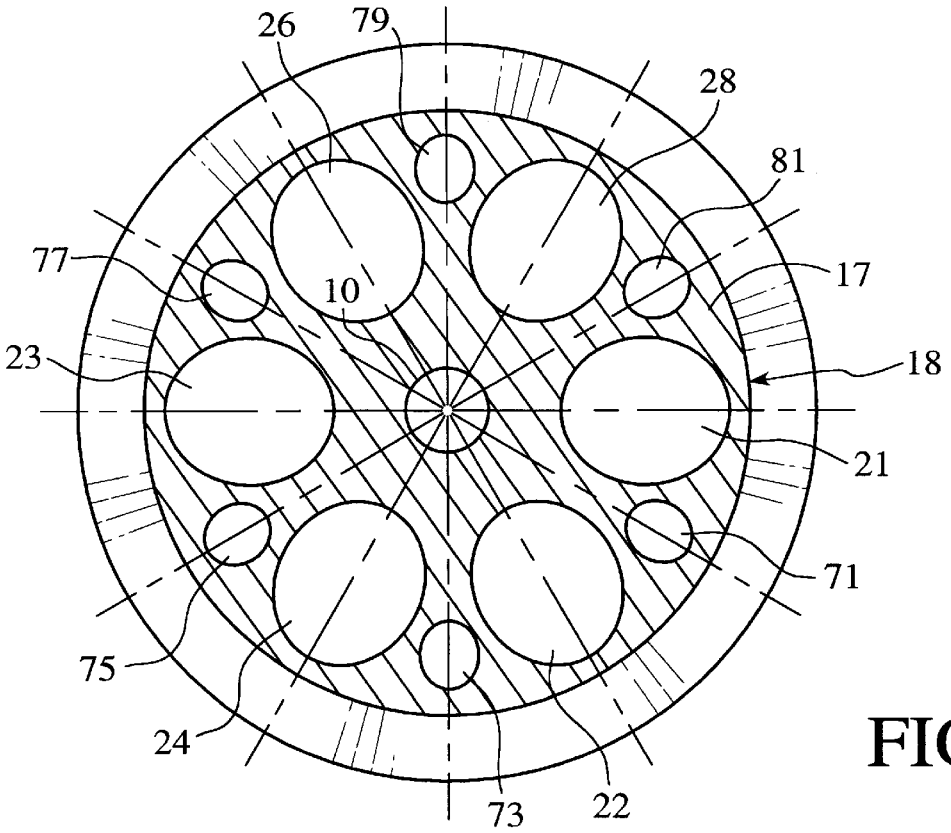
FIG. 6 is a horizontal sectional view of the solid mass centrifuge of FIG. 1, taken along lines 6—6 of FIG. 1.

In the cross-sectional view of FIG. 6, the rotor 17 may be seen to have a plurality of sample cells 21, 22, 24, 23, 26 and 28 which, in horizontal section, have an elliptical shape. The aforementioned elliptical cross-section results from the oblique angle which the centerline of each cell forms with the spin axis. Between the sample cells are the relief regions, with one relief region between each pair of sample cells. For example, relief region 71 is between cells 21 and 22. Relief region 73 is between cells 22 and 24. Relief region 75 is between cells 23 and 24. Relief region 77 is between cells 23 and 26. Relief region 79 is between cells 26 and 28 and relief region 81 is between cells 28 and 21. The relief regions also have an elliptical shape in horizontal section. In this sectional view, perpendicular to the spin axis 10, the portions of the rotor between sample cells 21, 22, 23, 24, 26, 28 and the relief regions 71, 73, 75, 77, 79 and 81 forms a plurality of spokes extending between the spin axis 10 and the outer surface 18 of the rotor.

The sample cells 21, 22, 24, 23, 26 and 28 are seen to be apertures of equal cross-sectional area at a uniform radial distance from spin axis 10. The relief regions 71, 73, 75, 77, 79 and 81 are also apertures, but have a second cross-sectional area and are spaced at a second radial distance from the spin axis. The cross-sectional area of the sample cells will generally be greater than the cross-sectional area of the relief regions in high volume centrifuges. However, it is possible to reverse the relative geometry so that the sample cells would have a smaller cross-sectional area when compared to the cross-sectional area of the relief regions.

The number of apertures of the first cross-sectional area may be equal to the number of apertures of the second cross-sectional area in order to maintain balance of the centrifuge. It will be seen that the apertures of the second cross-sectional area are spaced radially between apertures of the first cross-sectional area. Specifically, the radial line, about which each aperture having the second cross-sectional is centered is disposed equidistant from the radial lines bisecting one of two adjacent apertures having the first cross sectional area. This symmetry helps to maintain balance of the rotor 17. Alternatively, an additional set of mass relief apertures may lie on a radial line that is spaced-apart from the radial line upon which either the sample cells or the relief regions 71, 73, 75, 77, 79 and 81 lie.

Figure 7:
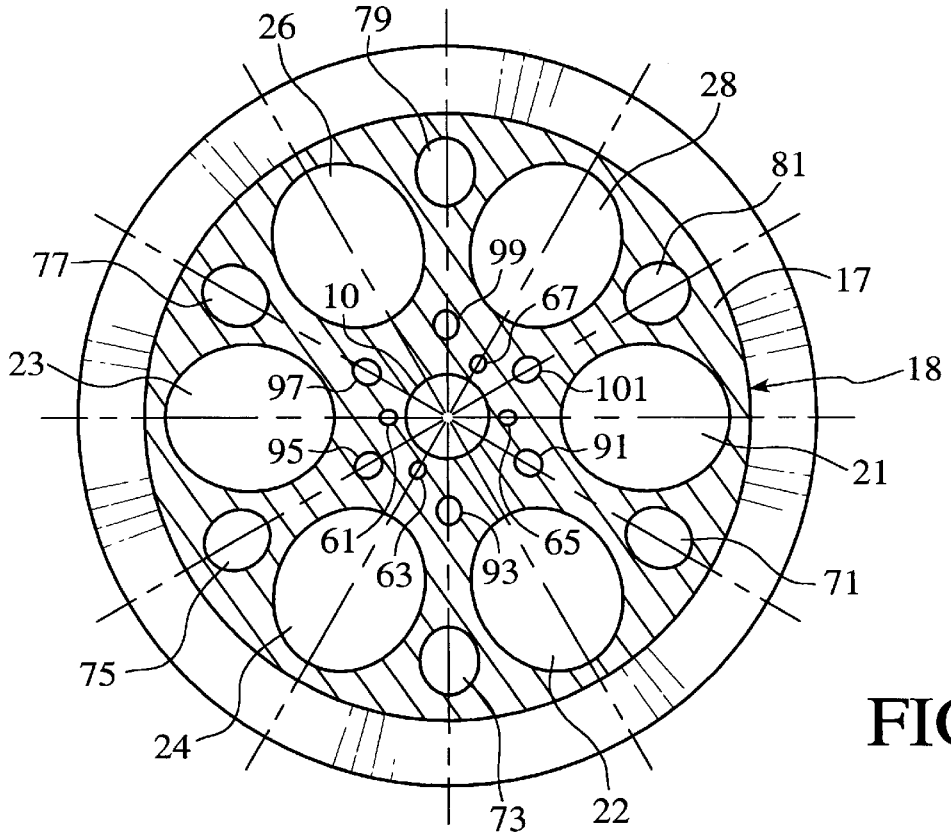
FIG. 7 is an alternate embodiment of the apparatus of FIG. 6.

Referring to FIG. 7, to provide additional mass relief, an additional set of relief regions 91, 93, 95, 97, 99 and 101 may be provided. Each of the relief regions of the second set 91, 93, 95, 97, 99 and 101 may be centered on a common radial line, with one of the relief regions 71, 73, 75, 77, 79 and 81. However, the aforementioned radial centering of relief regions 91, 93, 95, 97, 99 and 101 with relief regions 71, 73, 75, 77, 79 and 81 is not necessary so long as the balance of the rotor 17 is maintained. For example, another set of mass relief apertures 61, 63, 65, and 67 could be disposed radially inwardly the second set of apertures. This additional set of mass relief apertures could be positioned along the same radial line as the second set, or along the radial line of the first set, or both. On the other hand, relief apertures 61–67 lie on the radial lines of sample cells 21, 23, 24, and 28. As shown, the relief regions 91–101 lie on the same radial line as relief regions 71–81 but have smaller diameters. It is important to leave enough mass in order to avoid undue strain; and so, in the preferred embodiment, only a single relief region exists between each pair of sample cells. As in the prior art, the preferred rotor material is aluminum or titanium. In the case of aluminum, a block of aluminum is forged into the desired shape before machining the relief regions.

Figure 8:
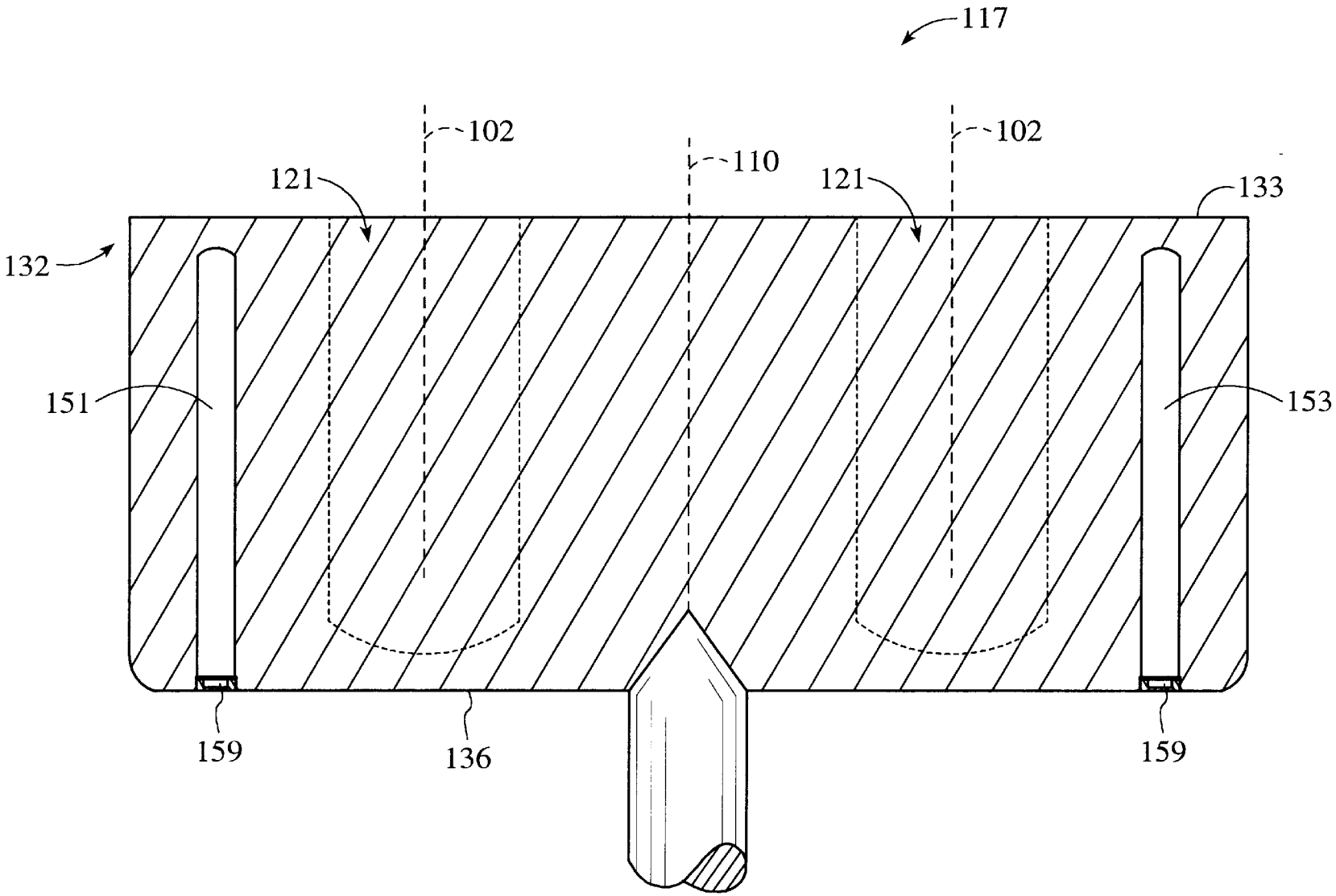
FIG. 8 is vertical sectional view of a vertical tube rotor in accord with an alternate embodiment of the present invention.

Referring to FIG. 8, a vertical tube rotor 117, in which a centerline 102 of each sample cell 121 extends parallel to the spin axis 110, is shown as including mass relief zones, such as bores 151 and 153. The vertical tube rotor 117, unlike the fixed angle rotor shown above, has a cross-sectional area which is substantially uniform over the length of the spin axis 110. That is the diameter of the rotor 117 at the plane of truncation 133 is approximately equal to the diameter of the rotor 117's underside 136, disposed opposite thereto. As a result, the vertical tube rotor 117 may be provided with mass relief regions, such as bores 151 and 153, having a uniform diameter along their entire length. This substantially simplifies the construction of the vertical tube rotor 117 having mass relief zones. As before, caps 159 are provided to seal bores 151 and 153, thereby reducing windage.

Moreover, the vertical tube rotor 117 may be provided with a greater percentage of inertial relief with the relief zones. Firstly, the uniform cross-sectional area of the vertical tube rotor 117 allows the bores 151 and 153 to be formed substantially larger in the upper regions 132 of the rotor 117 than is possible in the fixed angle rotor. Secondly, the distance between the relief zones and the spin axis 110 in the upper regions 132 of the rotor 117 may be greater than that provided in the fixed angle rotor. This results from the bores 151 and 153 being formed so as to extend parallel to the spin axis 110, thereby maximizing the distance therebetween. Additional inertial relief may be provided by providing relief zones at differing radial distances from the spin axis 119 similar to that discussed above with respect to FIGS. 6 and 7. In cross-section, unlike the apertures discussed with respect to a fixed angle rotor, the mass relief zones in a vertical tube rotor have a circular cross-section.

The invention claimed is:

1. A rotor for centrifugation of a sample container, the rotor comprising, a mass of material having rotational symmetry about a central spin axis and a peripheral wall extending from an upper truncation level to an underside, a plurality of holes for receiving the sample containers defined by orifices in the mass of material extending from the truncation level toward the underside, and a plurality of relief zones defined by apertures in the mass of material extending from the underside toward the truncation level and terminating in a closed end facing the truncation level, the relief zones having end caps sealing the underside.

2. The rotor of claim 1 wherein the relief zones are defined by a plurality of successive bores of different cross-sectional area formed into the underside of the mass of material, with a bore having a smallest cross-sectional area being positioned proximate to the truncation level and a bore having a largest cross-sectional area being positioned proximate to the underside.

3. The rotor of claim 1 wherein each of the plurality of holes has a centerline forming an oblique angle with respect to the spin axis.

4. The rotor of claim 1 wherein each of the plurality of holes has a centerline extending parallel to the spin axis.

5. A rotor for sample containers, the rotor comprising, a mass of material having rotational symmetry about a central spin axis and a peripheral wall extending from an upper truncation level to an underside, and a plurality of apertures located in the mass of material, including a first set of apertures defining sample cells, the first set of apertures extending from the truncation level toward the underside and having a size and shape for supporting the sample containers, and a second set of apertures defining relief zones, with each of the apertures of the second set extending between the underside and the truncation level and having a first end disposed adjacent to the underside and a second end disposed adjacent to the truncation level, with a cap disposed in the first end and the second end being covered.

6. The rotor of claim 5 wherein a portion of the mass of material is positioned to cover the second ends of the apertures of the second set.

7. The rotor of claim 5 wherein the first set of apertures is equal in number to the second set of apertures.

8. The rotor of claim 5 wherein the second set of apertures exceeds in number the first set of apertures.

9. The rotor of claim 5 wherein the first and second sets of apertures are symmetrically disposed about the spin axis of the rotor.

10. A centrifuge rotor for sample containers, the rotor comprising:

a rotor body having a spin axis, first and second opposed major surfaces, a plurality of bores, each of which is adapted to receive one of the sample containers, the plurality of bores spaced radially symmetric about the spin axis and extending toward the second major surface, and a plurality of recesses, formed in one of the major surfaces, each of which defines a mouth at said one of the major surfaces, and extends into the body therefrom, terminating in a closed end disposed between the first and second opposed major surfaces, each mouth of the recesses having a cap received therein to cover the mouth.

11. The rotor of claim 10 wherein the plurality of bores consists of six bores.

12. The rotor of claim 10 wherein each of the plurality of bores and each of the plurality of recesses have a cross-sectional area, with the cross-sectional area of each of the plurality of bores being greater than the cross-sectional area of each of the plurality of recesses.

13. The rotor of claim 10 wherein the plurality of recesses consists of first and second sets of recesses with the first set being disposed at a first radial distance from the spin axis and the second set being disposed at a second radial distance from the spin axis.

14. The rotor of claim 13 wherein the plurality of bores are disposed at a third radial distance from the spin axis.

15. The rotor of claim 14 wherein the third radial distance is less than either of the first or second radial distances.

16. The rotor of claim 14 wherein the third radial distance is greater than the first radial distance and less than the second radial distance.

17. The rotor of claim 14 wherein the third radial distance is greater than both the first and second radial distances.

18. The rotor of claim 10 wherein said rotor is a vertical tube rotor in which a centerline of each bore is parallel to the spin axis of the rotor.

19. The rotor of claim 18 wherein said recesses extend parallel to the spin axis.

20. A rotor for centrifugation of a sample container, the rotor comprising, a mass of material having rotational symmetry about a central spin axis and a peripheral wall extending from an upper truncation level to an underside, and a plurality of holes for receiving the sample containers defined by orifices in the mass of material extending from the truncation level toward the underside, the mass of material further having a plurality of cavities formed thereinto, the plurality of cavities being separated from each other by the material, the plurality of cavities extending from the underside toward the truncation level and terminating in a closed end facing the truncation level.

21. The rotor of claim 20 wherein the plurality of cavities each is defined by a plurality of successive bores of different cross-sectional area formed into the underside of the mass of material, with a bore having a smallest cross-sectional area being positioned proximate to the truncation level and a bore having a largest cross-sectional area being positioned proximate to the underside.

22. The rotor of claim 20 wherein the plurality of cavities each has an associated end cap sealing its underside.

23. The rotor of claim 20 wherein each of the plurality of holes has a centerline forming an oblique angle with respect to the spin axis.

24. The rotor of claim 20 wherein each of the plurality of holes has a centerline extending parallel to the spin axis.

25. The rotor of claim 20 wherein the plurality of holes is equal in number to the plurality of cavities.

26. The rotor of claim 20 wherein the plurality of holes exceeds in number the plurality of cavities.

* * * * *